US007524083B2

(12) United States Patent
Sandoval

(10) Patent No.: US 7,524,083 B2
(45) Date of Patent: Apr. 28, 2009

(54) INDUCTIVE LIGHTING FIXTURE USING A REFLECTIVE VENTED DOME

(76) Inventor: Ruben Sandoval, 31880 Yucaipa, Yucaipa, CA (US) 92339

( * ) Notice: Subject to any disclaimer, the term of this patent is extended or adjusted under 35 U.S.C. 154(b) by 161 days.

(21) Appl. No.: 11/282,274

(22) Filed: Nov. 18, 2005

(65) Prior Publication Data

US 2007/0115654 A1 May 24, 2007

Related U.S. Application Data

(63) Continuation-in-part of application No. 11/099,725, filed on Apr. 5, 2005, and a continuation-in-part of application No. 10/852,742, filed on May 22, 2004.

(51) Int. Cl.
*F21S 8/04* (2006.01)

(52) U.S. Cl. ..... 362/221; 362/147; 362/396

(58) Field of Classification Search ..... 362/221, 362/147, 396

See application file for complete search history.

(56) References Cited

U.S. PATENT DOCUMENTS

| | | | | | |
|---|---|---|---|---|---|
| 4,064,430 | A | | 12/1977 | Owens | |
| 4,403,277 | A | * | 9/1983 | Eargle et al. | 362/263 |
| 4,664,465 | A | | 5/1987 | Johnson et al. | |
| 5,356,314 | A | | 10/1994 | Aota | |
| 5,410,462 | A | * | 4/1995 | Wolfe | 362/365 |
| 5,440,471 | A | * | 8/1995 | Zadeh | 362/365 |
| 5,497,048 | A | | 3/1996 | Burd | |
| 5,528,473 | A | * | 6/1996 | Kassay et al. | 362/247 |
| 5,541,477 | A | | 7/1996 | Maya et al. | |
| 5,769,535 | A | * | 6/1998 | Rominger et al. | 362/396 |
| RE36,414 | E | | 11/1999 | Tickner | |
| 6,153,984 | A | * | 11/2000 | Fishbein et al. | 315/291 |
| 6,206,545 | B1 | * | 3/2001 | Yan | 362/249 |
| 6,286,981 | B1 | * | 9/2001 | McEllen et al. | 362/417 |
| 6,296,375 | B1 | * | 10/2001 | Sung et al. | 362/255 |
| 6,447,147 | B1 | * | 9/2002 | Kramer et al. | 362/297 |
| 6,598,990 | B2 | | 7/2003 | Li | |
| 6,758,580 | B1 | * | 7/2004 | Verfuerth | 362/241 |
| 7,201,491 | B2 | * | 4/2007 | Bayat et al. | 362/171 |
| 2003/0076677 | A1 | | 4/2003 | Mohacsi et al. | |
| 2004/0062041 | A1 | | 4/2004 | Cross et al. | |
| 2005/0259419 | A1 | * | 11/2005 | Sandoval | 362/249 |
| 2006/0039168 | A1 | * | 2/2006 | Mier-Langner et al. | 362/648 |
| 2006/0221621 | A1 | * | 10/2006 | Ruben | 362/368 |

* cited by examiner

*Primary Examiner*—Jong-Suk (James) Lee
*Assistant Examiner*—Leah S Lovell
(74) *Attorney, Agent, or Firm*—Kirk A. Buhler; Buhler & Associates

(57) ABSTRACT

A lighting fixture where the lighting fixture uses inductive lighting technology or self ballasting lighting elements with one or a plethora of efficient light elements. The lighting fixture is used where high bay or low bay lighting may be used, but incorporates multiple light sources to provide an equivalent light intensity. The multiple light sources can be inductive or multiple fluorescent, LED or other efficient light sources to provide a less expensive cost of operation and installation. The higher efficiency lights could be standard socket type fluorescent or inductive light bulbs that are easily available. The higher efficiency lights will also create less heat that will further reduce the air conditioning or cooling costs for the building. An integrated ballast box with reflector dome retainer is also shown for use with inductive or other lighting that further includes a retaining mechanism for the dome.

20 Claims, 9 Drawing Sheets

INDUCTIVE LIGHTING FIXTURE USING A REFLECTIVE VENTED DOME

CROSS REFERENCE TO RELATED APPLICATION

This application is a continuation-in-part of applicant's co-pending application Ser. No. 11/099,725 filed Apr. 5, 2005, and Ser. No. 10/852,742 filed on May 22, 2004 the entire contents of which is hereby expressly incorporated by reference herein.

FIELD OF THE INVENTION

The present invention relates generally to a bay lighting fixture using multiple self-ballasting bulbs or inductive light elements. More specifically the invention is designed to replace a high-bay, low-bay warehouse or similar lighting fixture. The invention may include a hanging system that allows the entire assembly to be wired into a new or existing building and supply self ballasting lights, or ballast box and the dome. This fixture uses multiple high efficiency standard fluorescent single or multiple inductive lighting or other high efficiency light bulbs or lamps. An integrated ballast box with reflector dome retainer is also disclosed for use with inductive or other lighting where the housing includes a retaining mechanism for the dome.

BACKGROUND OF THE INVENTION

Lighting is used to provide light when it is dark or to provide supplemental lighting for a dark area. Often in large buildings, overhead lighting is provided from lights placed near the ceiling of the building and the light is directed downward. Most light bulbs used in these lighting installations are inefficient, and a portion of the energy used in these lights is expended in heat. In the summer, the heat must be cooled with the building air conditioning system. The maintenance cost of these bulbs is also high due to the cost of government imposed lamp disposal fee, the short lifespan and the rapid degradation of 30 to 40% after a year. What is needed is a new lighting fixture that includes the ballast and may further include the dome that can easily be replaced with existing fixtures simply by having a new energy efficient fixture. The ballast is provided with multiple high efficiency fluorescent or inductive lighting bulbs that provide equivalent or superior illumination with improved efficiency and a reduction in the amount of heat that is generated. The invention proposed provides a solution to all the listed requirements.

U.S. Pat. No. 5,497,048 issued to Burd is for a fluorescent bulb that has multiple fluorescent elements located within the light bulb. This invention provides the equivalent energy efficiency and an equivalent amount of light, but the bulb is a custom light bulb, and the light bulb is not manufactured in high volume. The invention does not provide multiple efficient light bulbs that are cost effective and readily available.

U.S. Pat. No. 5,541,477 issued to Maya et al. is for a single fluorescent bulb that also has multiple fluorescent bulb elements that are connected into a single screw-in base. This invention provides the equivalent energy efficiency and the equivalent amount of light, but the bulb is a custom light bulb, and the light bulb is not manufactured in high volume. The invention does not provide multiple efficient light bulbs that are cost effective and readily available.

U.S. Pat. No. 4,664,465 issued to Johnson et al. is for a bulb with a clip attached that allows the bulb to be attached to a metal strip. The patent covers the clip connected to a hollow tube that can extend from a vertical or horizontal surface. This invention uses a single bulb connected to an elongated metal tube or neck. The invention is intended for wiring to an electrical power source. The invention does not include multiple light sockets that connect into a base that can be screwed into a lamp base.

U.S. Pat. No. 5,356,314 issued to Aota is for a double-socket electric lamp that screws into an existing lamp base and converts the lamp into a standard lamp socket so a more standard bulb can be screwed into the second socket. This invention is for converting a high output light bulb into a low output light bulb. The invention replaces a single light bulb with another single light bulb. The invention is a converter for converting a light bulb socket from one size to another. The invention is not intended for converting a single light bulb socket into multiple light bulb sockets.

The ideal product would be used where high or low bay lighting would be used that might require a ballast or self ballast energy efficient lighting solution for operation. Standard high efficiency light bulbs could be inserted into the multiple sockets to provide equivalent light intensity at a significant reduction in the energy being used. A single or multiple inductive light elements also provides improved illumination with a longer life expectancy of 500%. The integration of the fixture with the dome as one piece further reduces the components and the cost of manufacturing.

BRIEF SUMMARY OF THE INVENTION

It is an objective of the present invention to provide an energy efficient lighting system. This system is used instead of a single incandescent light bulb that requires a ballast. The lighting fixture is a single fixture configured for multiple standard higher efficiency self ballasting bulbs. The invention may also include a dome or other reflector or fixture design to focus the light downward. The fixture involves an inductive light socket candelabra that are wired where warehouse lighting may be used that may or may not require a ballast.

A standard 100-watt incandescent bulb uses 100 watts of energy, a fluorescent light (or inductive light) bulb that provides the same amount of light only requires about 20 to 25 watts of energy. Fluorescent light consume 45 to 50% less energy than a standard incandescent light bulb. The light from fluorescent light is similar or superior to the light from an incandescent light, and can be tinted to provide different shades to simulate other lighting sources. The fixture requires the installation onto the rafters or ceiling of the building where it is installed to produce light that is emitted above and below the lighting fixture as well as out the sides of the lighting fixture. A candelabra lighting fixture is then snapped into an existing dome. A reflector dome located in the lighting fixture helps to focus the lighting down to where the light is needed. An inductive light source provides an improved lighting source 20 to 30% brighter than standard fluorescent bulbs with increased efficiency and 50% longer bulb life.

A warehouse typically uses 450-465 watt incandescent, halogen or similar light bulb and ballast system. The proposed invention replaces the single 400-watt light bulb with five fluorescent or inductive self ballasting fluorescent lights providing the same or more illumination. The standard warehouse light uses 450-465 watts to produce the light. The five self ballasting fluorescent lights only require 240 to 250 watts of energy. An inductive light source only requires 200 to 220 watts of energy to produce the same amount of illumination, saving 170 to 255 watts of energy that would be spent in heat. A 400 watt metal halide light operates at 1750 degrees of heat, where a fluorescent or inductive lamp operates at 190 to 210 degrees. Inside an air conditioned building the 170 to 255 watts of heat would need to be cooled with the air conditioning system within the building. The savings come from three places, first the more efficient lights, second from air conditioning costs and third, from less maintenance costs. In addition, there can be safety benefits from less ultraviolet rays, and for less chance that the fluorescent bulbs will explode. Inductive lighting provides improved efficiency and savings where a standard warehouse light uses 450-465 watts to produce the light. One to three inductive lights may require as little as 200 watts of energy to produce more light than a standard warehouse light and will provide saving of 250 to 265 watts of energy and 1500 degrees of heat would be spent in heat. Inside an air conditioned building the 1750 degrees of heat would need to be cooled with the air conditioning system within the building. The savings come from three places, first the more efficient lights, and second from air conditioning costs, induction lamps further reduce re-lamping costs by 500%, or mounted separately to 600% reduce, and third the maintenance and government imposed hazardous waste disposal costs.

When the new lighting fixture is installed into a new or existing building the enclosure for the ballast may be eliminated. The multiple bulbs can be as little as two to as many bulbs that are required to provide equivalent light output and wattage drop for the incoming voltage. If the lighting is 120 VAC or 277 VAC, multiple 120 VAC or 277 VAC fluorescent, 120 VAC, 277 VAC inductive lighting bulbs can be used to achieve equivalent or superior light output. Other light bulbs operating at up to 480 VAC with the capability of being dimmed are contemplated.

The lighting fixture can be separated from the ballast box and mounted or hung separately where the installation calls for reducing the height by as much as 40%. This allows improved cosmetics, height without compromising the efficiency or operation of the fixture. The components of the fixture are designed to allow the parts to be connected or separated in the field without requiring additional components.

The construction of the lighting fixture consists of a joist or ceiling mounting system where the fixture can be suspended from a chain or hard mounted. The electrical wires from the building are wired into the top of the fixture, where it is wired into each of the sockets in the candelabra fixture. The candelabra arrangement consists of at least two bulb sockets that extend from a base structure. The bulbs can extend from fixed or flexible arms, goosenecks. The bulbs can be threaded into multiple sockets from the base. The sockets can be wired in series, parallel or combined series and parallel arrangement that keeps the voltage to a safe level for the lights screwed into the sockets.

A reflector or dome can be integrated onto the lighting fixture to eliminate the hanging fixture normally associated with high bay lighting. The reflector or dome is retained on the lighting fixture with retaining snap locks and gravity. The reflector focuses light down from the fixture, while a dome helps to defuse the light and provide lighting that is emitted up, down and out the sides of the lighting fixture.

One problem with placing a toroidal lighting element within the dome is the shadow that exists from the light of the lighting element blocking the light emitted from the back side of the lighting element. Different light diameters and different dimensions will yield varying reflective angles that will reflect the light from behind the lighting element to the front of the lighting fixture to eliminate the shadow that can be appear under the lighting dome. The internal geometry to minimize or eliminate the shadow. The proposed lighting apparatus minimizes the blocked light by reflecting light around the toroidal, inductive lighting element.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
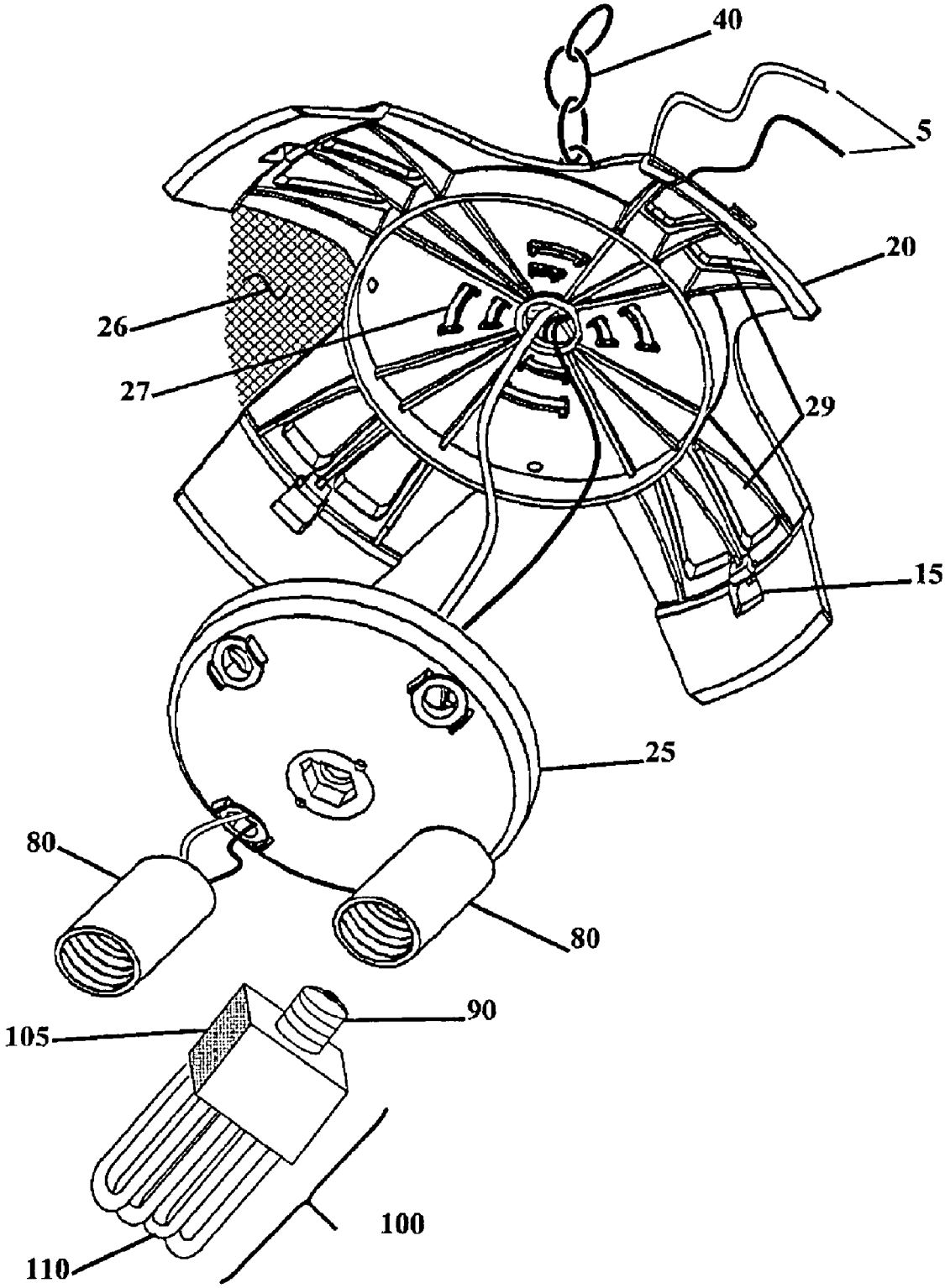
FIG. 1 is an isometric exploded view of the lighting fixture.

Referring first to FIG. 1 that shows an isometric exploded view of the lighting fixture. The fixture works with store, warehouse or industrial lighting systems. The lighting fixture is intended for use as high bay, low bay lighting or similar lighting fixture where incandescent, halogen, sodium, metal halide, mercury vapor or other less efficient light bulbs are used. The wiring 5 is shown exiting the housing. Four tabs 15 are arranged on the upper section 20 of die fixture for locating and retaining a reflective dome 10. Four tabs 15 (one on each wing) are shown for locating the reflective dome 10. But more or less tabs 15 can be used. The figures show the upper section 20 with four tabs 15 used to retain the reflective dome 10, but as few as two or three tabs 15, or more than four tabs 15 are contemplated with other designs. It is also contemplated that a ridge can be incorporated into the housing to retain the reflective dome 10 without any tabs 15. The bottom fixture reflector helps to improve the efficiency of the lighting by directing light downward. The reflector comprises an ultra-efficient positioned surface that provides optimum reflective efficiencies. The reflective dome can provide narrow to wide distribution of the light based upon the application and the spacing of the lights. The reflective dome 10 is attached to upper section 20 that include an attachment tab for a mounting chain 40 or pipe hard mount integrated or attached to the upper section 20. Vents 29 are shown in this figure.

The vents 29 allow natural hot air convection to occur and vent out of the fixture. Without the vents in the fixture, the lights within the dome create heat that remains trapped within the fixture and dome. The heat can exceed several hundred degrees and cause damage and ultimately failure to the fixture and lights. The shape, location, and configuration of the vents have been specifically designed to optimize air movement through the fixture to allow for natural cooling of the bulbs and fixture with a minimal compromise of the light being reflected downward.

The housings shown here are in two different sections, but the housing may be a single housing, or may include more than two sections where a lower section 25 includes a connection means for the threaded female sockets 80 and an upper section 20 that includes mounting for the reflective dome 10 and the hanging attachment for use with a chain 40 or similar pipe hangar to suspend the assembly to the ceiling or a joist. The chain 40 is shown connected through a hook 35 mounted on the lop of the fixture. The hook 35 allows for a variety of attachment methods including but not limited to chain, wire, cable, pipe or clips that allow the fixture to permanently or temporarily be connected. The upper and lower sections are configured as a junction box or J-box to allow the wiring 5 to be safely enclosed within the two sections. The housings may be constructed from die-cast aluminum, which allows greater heat dissipation and provides greater corrosion resistance. To improve heat dissipation and resistance corrosion, an acrylic powder coat finishes can be applied to both the inside and outside surfaces of the housing. The housing may contain a built-in thermal venting chamber cast into the housing. In the preferred embodiment the housing is molded from a high temperature plastic material. Venting may be included to allow natural cooling of the fixture, and in the embodiment shown, as the cross hatched area opening(s) 26, in the upper section 20 to allow air to free flow through the lighting fixture. Air movement allows operation of fixtures at higher ambient temperatures. Internal vents 27 are shown in the upper section 20 to allow air to exit out of the upper section 20.

The hanging attachment consists of a simple structural hole or hook 35 that a pipe or chain can pass under or through to support the entire assembly from the ceiling. The body is a metal, ceramic, plastic or other type that can support the components and operate in the temperature that the lighting fixture will operate. The body will have more than one threaded female socket 80. In the preferred embodiment, the threaded female socket 80 is a mogul base, but may be intermittent, medium, candelabra, bayonet or a pin type base. The Mogul base is used because the Mogul base is a very common standard commercial light bulb base that is available from a variety of sources. A number of companies make fluorescent or inductive light bulbs with Mogul male threaded bases 90. A tube may extend from the lower section 25. The tube may be straight or bent as a gooseneck. The tube may be made from multiple pieces or may be bendable or adjustable to change the direction of the light. At the end of the tube a threaded female socket 80. In the preferred embodiment, three to five bulbs are used with one bulb located in the center of the fixture and four bulbs are located around the center bulb, where each of the peripheral sockets located 90° apart. Three bulbs 100 can be located 120° apart. Bulbs can be added that could be spaced equally or grouped on one or more sides. A male socket 90 is shown as part of a standard fluorescent or inductive lighting bulb 100. The replacement bulb 100 has an area for the ballast 105. The ballast 105 controls power to the fluorescent or inductive lighting tubes 110.

Figure 2:
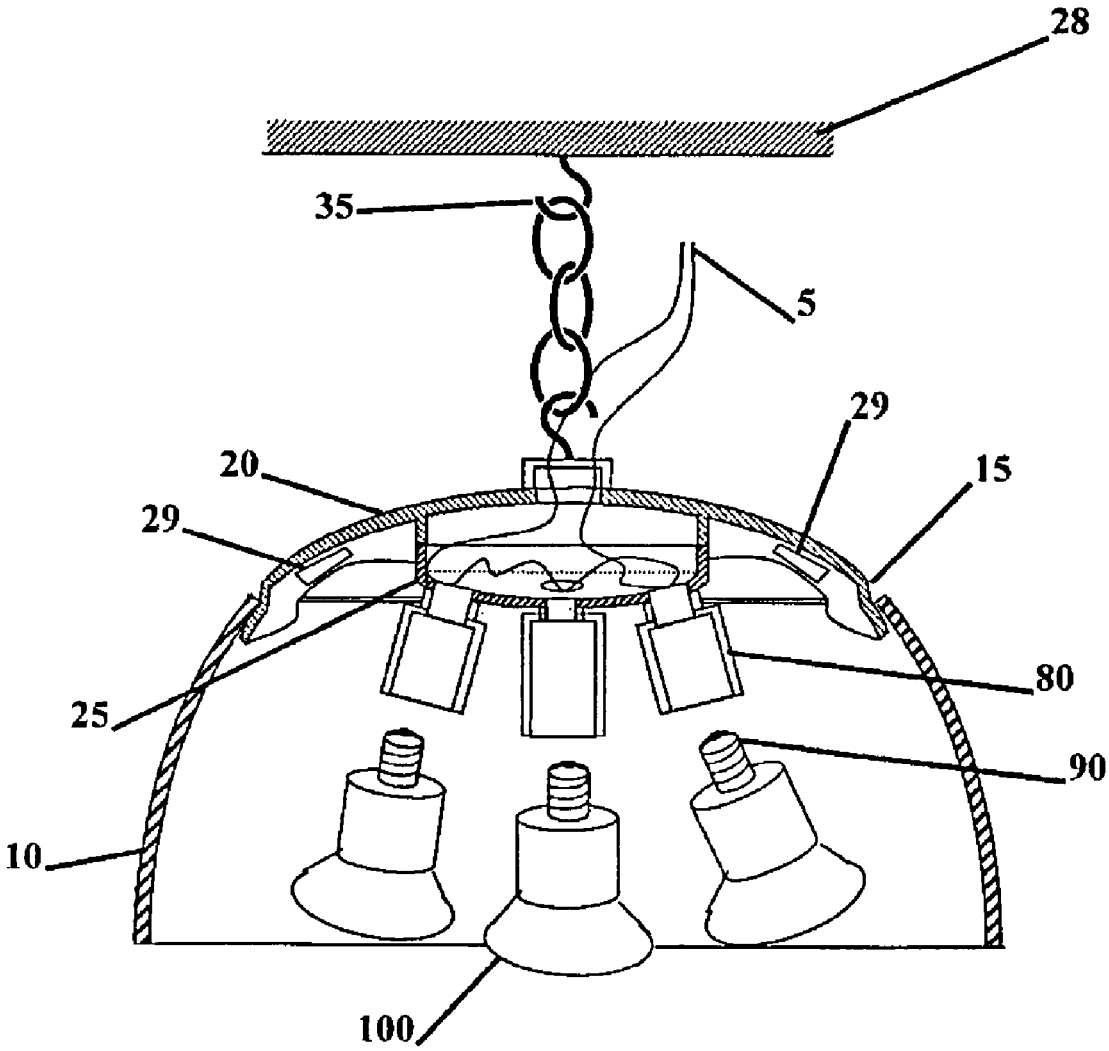
FIG. 2 is a cross sectional view of the lighting fixture showing the internal components.

Referring now to FIG. 2 that show a cross sectional view of the internal components. The reflective dome 10 is shown in this figure attached to the lighting fixture. The reflective dome 10 is connected to the upper section 20 with tab(s) 15. The chain 40 is shown connecting the upper section 20 with a hook 35 in the ceiling and fixture. A single ballast 105 is not required with this fixture because each fluorescent or inductive light bulb 100 installed into the fixture includes integrated ballast. The housing in this figure is shown attached to rafter joist 28. The housing shown provides the structural support to retain the lighting fixture and the reflective dome 10. The wiring 5 is shown exiting the housing. While the wiring 5 is shown exiting the upper section 20 for connection to an external junction box, J-box or other connection, the wiring 5 may be brought into the housing from the wiring 5 of the building and connected within the light fixture in its internal junction box, j-box or other connection. The lower portion of the housing has a threaded female sockets). The standard fluorescent or inductive lighting light bulb 100 is shown in this figure. The bulb 100 in this figure is a flood or spot light configuration. The base 90 of a standard bulb 100 is shown removed from the threaded female socket 80 in the fixture.

Figure 3:
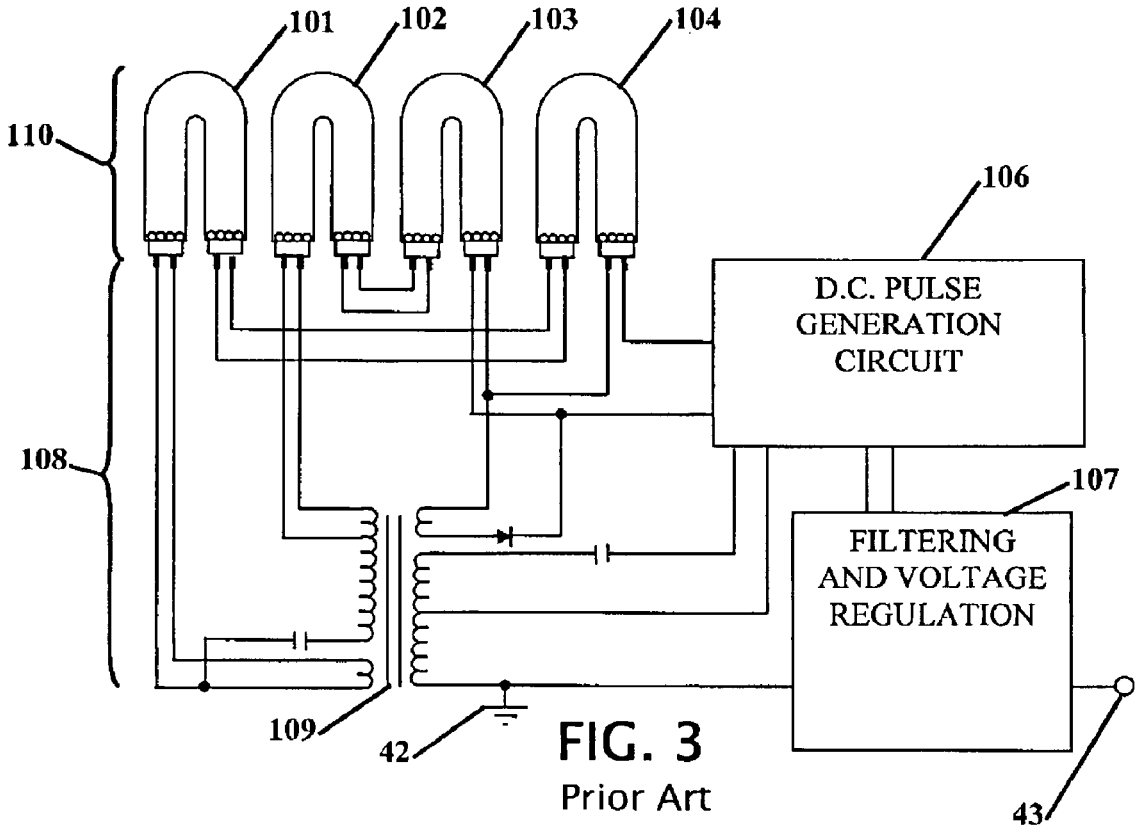
FIG. 3 Prior Art
FIG. 3 is an electrical diagram of the internal ballast of a fluorescent light bulb.

Referring now to FIG. 3 that show an electrical diagram of the internal ballast of a fluorescent or inductive lighting light bulb. In the US, the ballast is made for 120, 240, 277 or 480 volts. In Canada, ballast options include 120, 240, 277 and 347 volts. In a standard fluorescent or inductive bulb, ballast 108 is located with the base of the bulb. The self ballast contains a DC pulse generation circuit 106, and a filtering and voltage regulation portion 107 and a transformer 109. The tip of the male bulb 43 is connected to the filtering and voltage regulation circuit. The threaded portion of the male bulb is connected to the ground point 42. The light emitting portion of the bulb 110 may contain one or multiple bulbs 101, 102, 103 and 104. All these components may be found in a standard replacement fluorescent or inductive light bulb that can be connected into the fixture.

Figure 4:
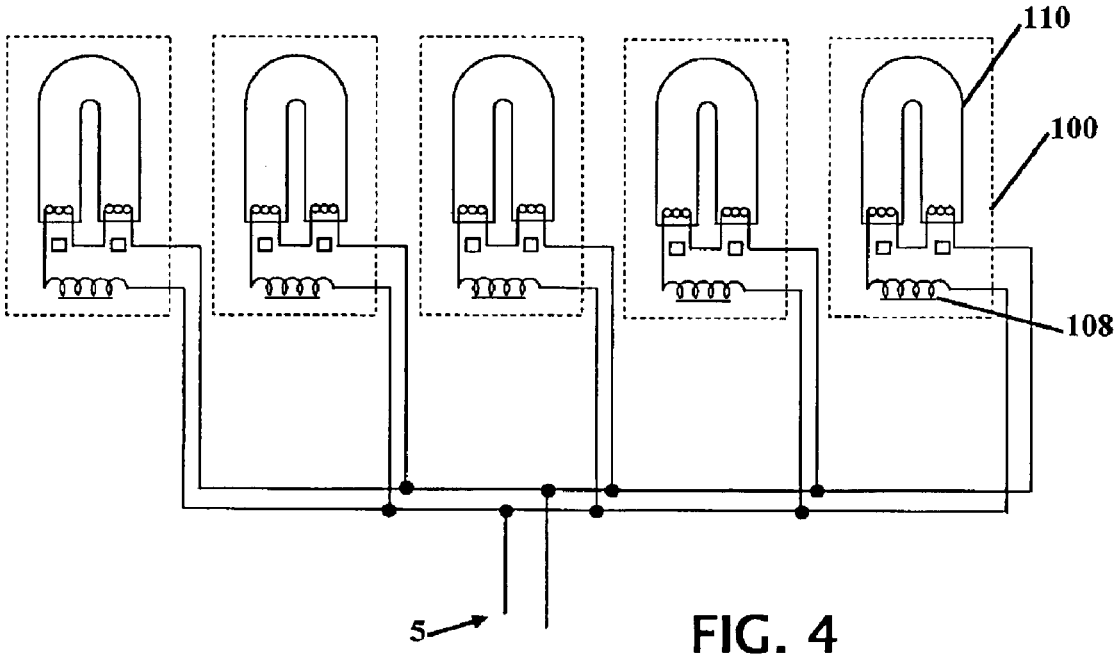
FIG. 4 is a schematic representation of the wiring within the lighting fixture.

Referring now to FIG. 4 that show a schematic representation of the wiring within the fixture. When the fixture is wired into an existing building the ballast and the ballast junction box can be removed. The fixture has wiring that connects from the buildings electrical system to the multiple bulb fixtures. The multiple bulbs can be as little as two to as many bulbs that are required to provide equivalent light output and voltage drop for the incoming voltage. If the lighting is 120 or 277 VAC, multiple 120 or 277 VAC fluorescent or inductive light bulbs can be used to achieve equivalent or superior light output. Lighting bulbs with voltages up to 480 VAC can also be used in the lighting fixture. The most cost effective standard replacement bulb is a fluorescent or inductive light bulb, but other efficient light sources such as LED's, or sulfur based or other efficient lighting devices may be used.

The construction of the fixture consists of using electrical connectors used with the existing light electrical system. An electrical connection is made with the corded connector of the fixture. The wires are then connected to a candelabra arrangement of light bulb sockets. The candelabra arrangement consists of at least two bulb sockets that extend from a base structure. The bulbs can extend on fixed, flexible arms or goosenecks. The bulbs can be threaded into the multiple sockets from the base. The sockets can be wired in a series, parallel, or combined series and parallel arrangement that keeps the voltage to a safe level for the lights screwed into the sockets.

Figure 5:
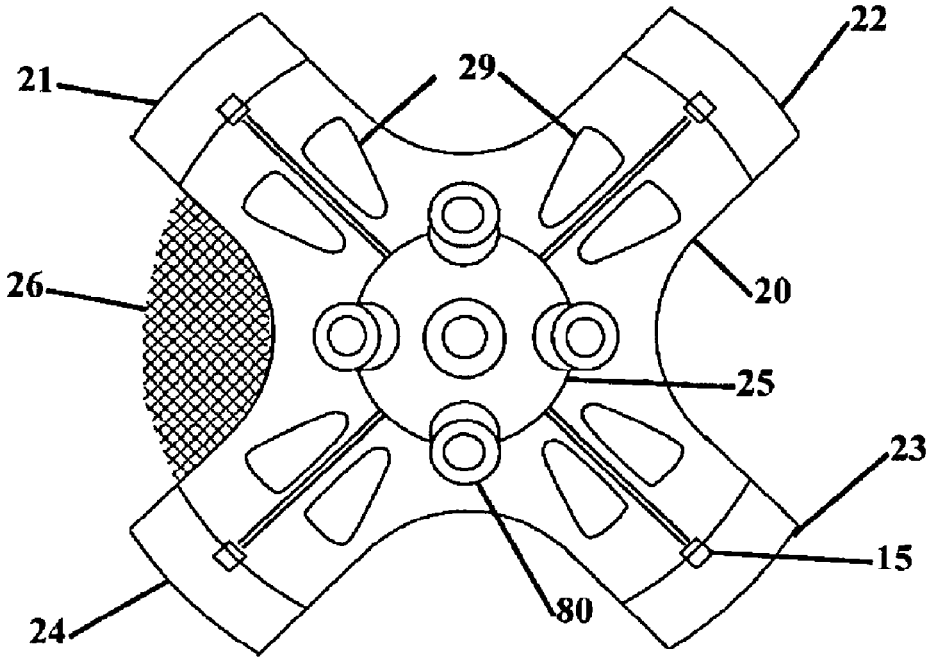
FIG. 5 is a bottom view of the lighting fixture
Figure 6:
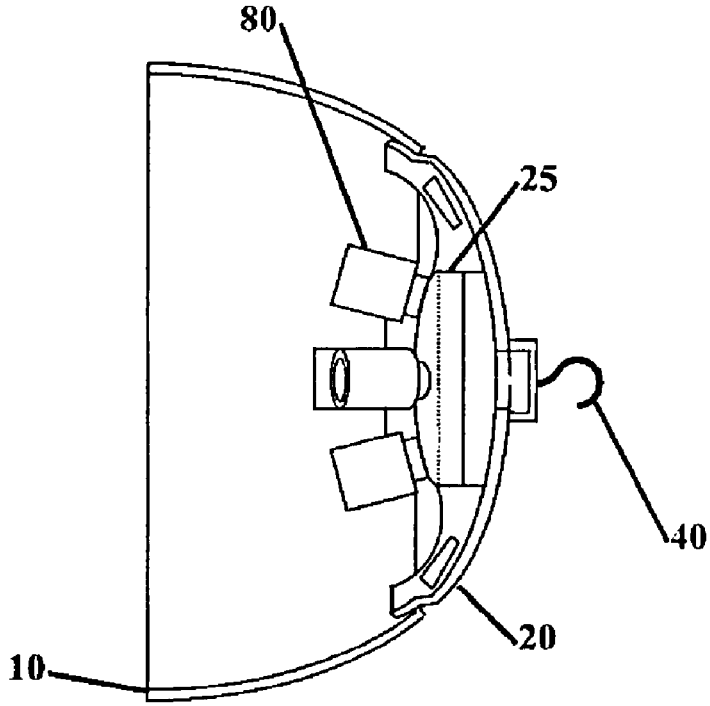
FIG. 6 is a side view of the lighting fixture.

Referring now to FIGS. 5 and 6 that shows a bottom view and side view of the lighting fixture respectively with the dome or reflector removed in FIG. 5. One link of chain 40 is shown in FIG. 6. This link 40 is shown connected to the top of the fixture. The lower section 25 of the fixture is shown connecting the male sockets 90. In FIG. 5 the four wings of the fixture 21, 22, 23 and 24 can be seen with the openings 26 that allows air movement through the fixture. Eight vents 29 positioned around the fixture allow heat to vent from the fixture to reduce damage from the heat generated by the fluorescent or inductive lighting lights. The venting is specifically engineered to keep one or multiple self-ballasting fluorescent or inductive bulbs at a constant cool operating temperature. The cooler operating temperature can significantly extend the life of self-ballasting bulbs. While eight vents are shown within the fixture, multiple other venting options are contemplated that provide a more constant operating temperature. These options may include fabricating the fixture from a wire or steel mesh with multiple holes, or fabricating the fixture from tubes or rods to suspend the reflective dome 10 or a complete outer rim o hold a reflective dome 10 more securely.

Figure 7:
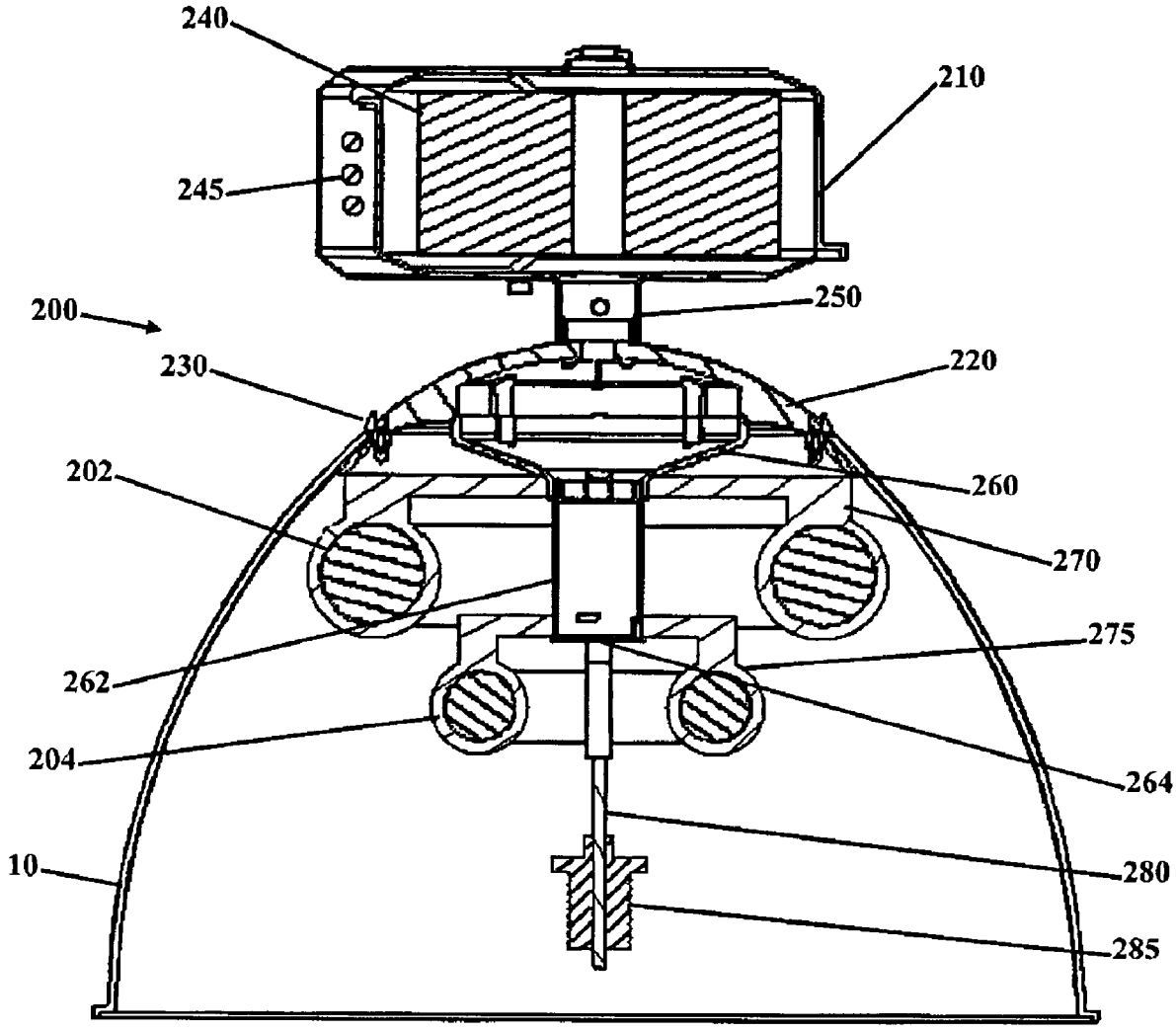
FIG. 7 is a sectional view of a high bay lighting fixture using inductive lighting elements.

FIG. 7 shows a sectional view of a bay lighting fixture using inductive lighting elements 200. The reflective or focusing dome 10 directs light from the lighting elements 202 and 204 downward so more of the light shines where desired. This figure show two lighting elements of different size, but the size, shape and output illumination of the lighting elements can be the same or different depending upon the desired amount of light that is required. The reflective or focusing dome 10 is attached to the housing with clips or fasteners 230. The dome rests on the enclosure 220, where gravity and the retaining fasteners 230 lock the dome in place. The shape and configuration of these clips is shown and described in more detail with FIG. 8 below. The dome retainer is connected or integrated with a connecting tube 250 that supports the lighting and dome in addition to providing a conduit for wiring. The connecting tube 250 is attached to the ballast enclosure. In some configurations contemplated, the ballast box may be empty, when the ballast is included with the lighting elements. The ballast 240 is shown housed in the ballast box 210. One configuration of electrical connection to the ballast is with screw terminals 245, but the wiring connection(s) could be made with twist-on wire connectors or spring clips where the wires are pushed into the terminals and retained by spring force that both retain the wires and provide electrical connection between the ballast and the external wiring. An electrical connection from the ballast extends through tube 250, into the dome retainer 220 for connection with the lighting elements 202, 204 or lighting socket for the lighting elements. Locking bars 270 and 275 hold the inductive lighting elements in place within the dome and on the lower cover 260 that is capped with an extender 262, and an extender cap 264. The extender allows the placement and retention of the additional lighting element 204 that holds locking bar 275.

A lower cover 260 encloses the lower portion of the housing to protect the electrical wiring 5. The ballast box 210, dome retainer 220, and the lower cover 260 can be fabricated using a number of different methods including but not limited to casting, machining, drawing, forming or molding. In the preferred embodiment the part are made from an injection molded process. The materials for these components can also be variety of types including but not limited to plastics, resins, ceramic, ferrous and non-ferrous materials, with the qualities of strength, heat resistance. A safety locking mechanism 285 is installed on the end of retaining cable 280 to hold the light fixture in position. While in this figure the retaining mechanism 285 is shown extended from the retaining cable 280, upon installation the safety device is secured against the bottom of the lighting fixture.

Figure 8:
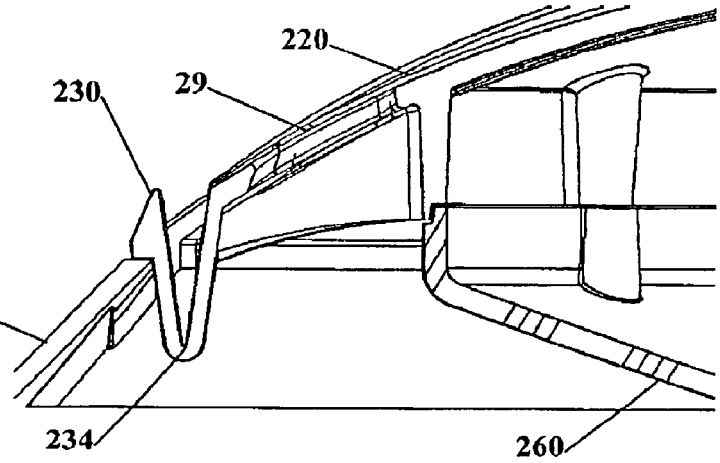
FIG. 8 is a detailed cross sectional view of the lighting fixture from FIG. 7 showing the retaining tab.

FIG. 8 is a detailed cross-sectional view of the lighting fixture from FIG. 7 showing the fastening retaining tab 230. The reflective dome 10 shown resting upon a portion of the dome retainer 220. For installation, the reflective dome 10 is brought over the dome retainer 220, the fastening tab 230 will flex inward from the hinge area 234 allowing the reflective dome 10 to pass by the clip, and then spring back into position locking the reflective dome 10 under the tab. Once the reflective dome 10 is in position, gravity, in addition to the fastening tabs 230 will keep the reflective dome 10 resting on the dome retainer 220 and all around the dome retainer 220. The lower housing 260 is shown in position under the dome retainer 220 protecting the wiring 5 connections. Vent 29 is shown in this view as it passes through the dome retainer 220. The vents are a critical part of the design because they allow heat from the room and from the lights to vent out of the fixture.

Figure 9:
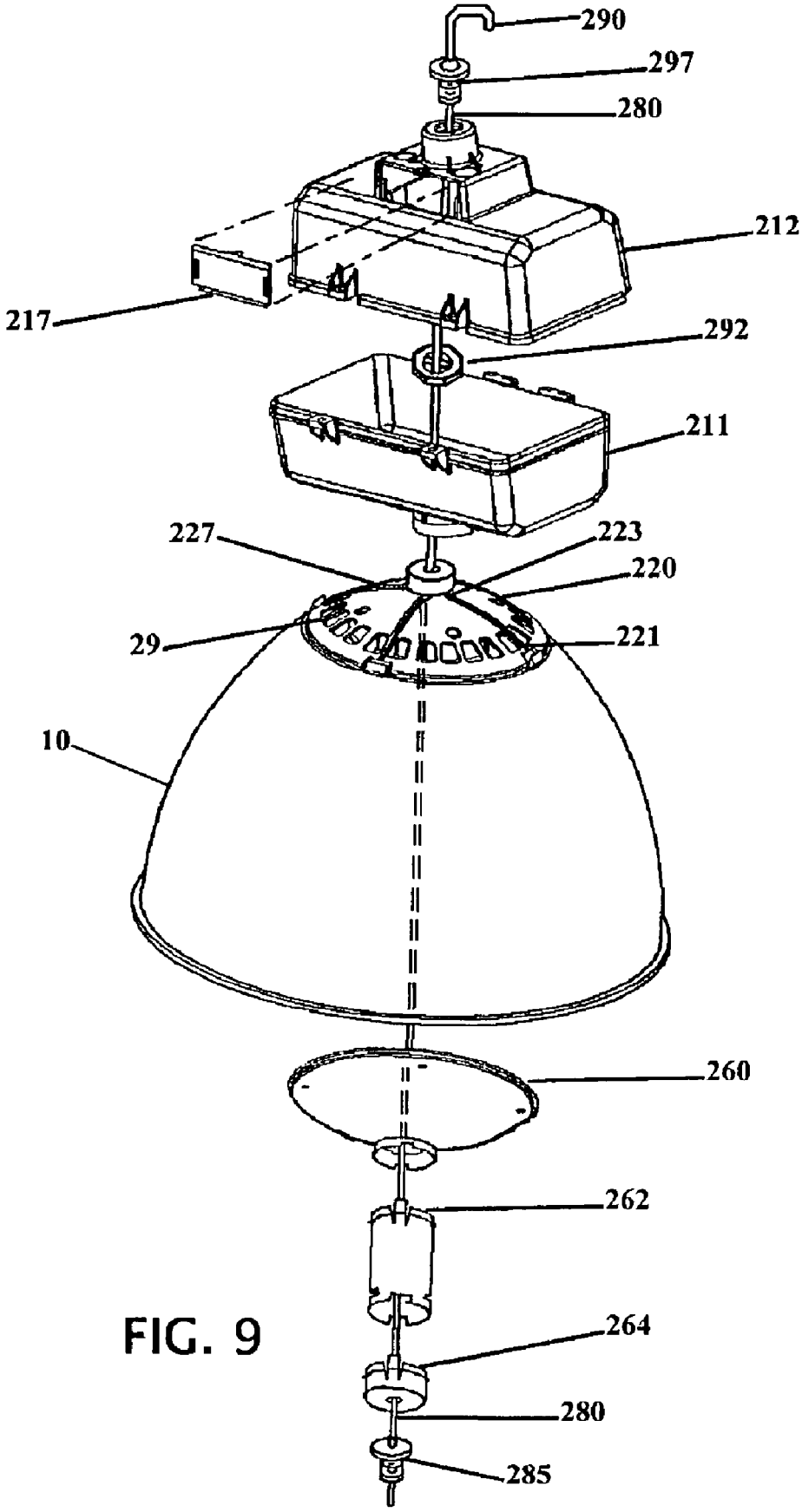
FIG. 9 is a perspective view of the lighting fixture showing the arrangement of the components.

FIG. 9 is a perspective view of the lighting fixture showing the arrangement of the components. A retaining cable 280 passes through the entire lighting fixture and is secured with a safety line 285 located at the end of the cable. The top portion of the retaining cable 280 is attached to a hook 290 that can be secured to the ceiling or joists of a building. The bottom portion 297 of the hanging hook 290 is secured to the ballast box with a nut 292 that is threaded onto the end of the hook 290 at 297 from inside the ballast box. The reflective dome 10 is shown below the dome retainer 220. A seams 221, 223, 227 are shown in this figure. The seam allows the dome retainer 220 to be fabricated in multiple sections that can be connected. In the embodiment shown, the dome retainer 220 is made from four pieces. In another contemplated embodiment, the dome retainer 220 and at least a portion of the ballast box is made from a single component. The enclosure for a ballast is shown located above the lighting fixture with a top housing 212, bottom housing 211 and an access cover 217. In this embodiment the top and bottom housings are connected with a hinged arrangement with a closure. In yet another contemplated embodiment, the ballast box dome retainer 220 and connecting pipe are made in two halves. This view shows the dome retainer 220 essentially as a dish shape but other similar shapes can be used. The lower cover 260 is shown under the reflective dome 10 and it is attached to the dome retainer 220. The design of the lower cover is critical to the transmission of light around the lighting element(s). A description of the design requirement to reflect light around the lighting elements is shown and described with figure 12. The extender 262 is shown below the lower section 25 and attaches to the lower section 25. The extender cap 264 is shown below the extender and closes the opening in the bottom of the extender 262. Another contemplated option is to attach the reflective dome 10 with the hook 290 tat allows the reflective dome 10 to be attached separately from the ballast as shown and described in more detail in FIG. 11.

The disk shape is ideal because it allows for any heat to be channeled up through the lighting fixture. Vents 29 are shown around the dome retainer 220. In the embodiment shown the vents are essentially rectangular in shape, but other shapes are contemplated to include but not be limited to rectangular, circular, elliptical vents or combination thereof.

Figure 10:
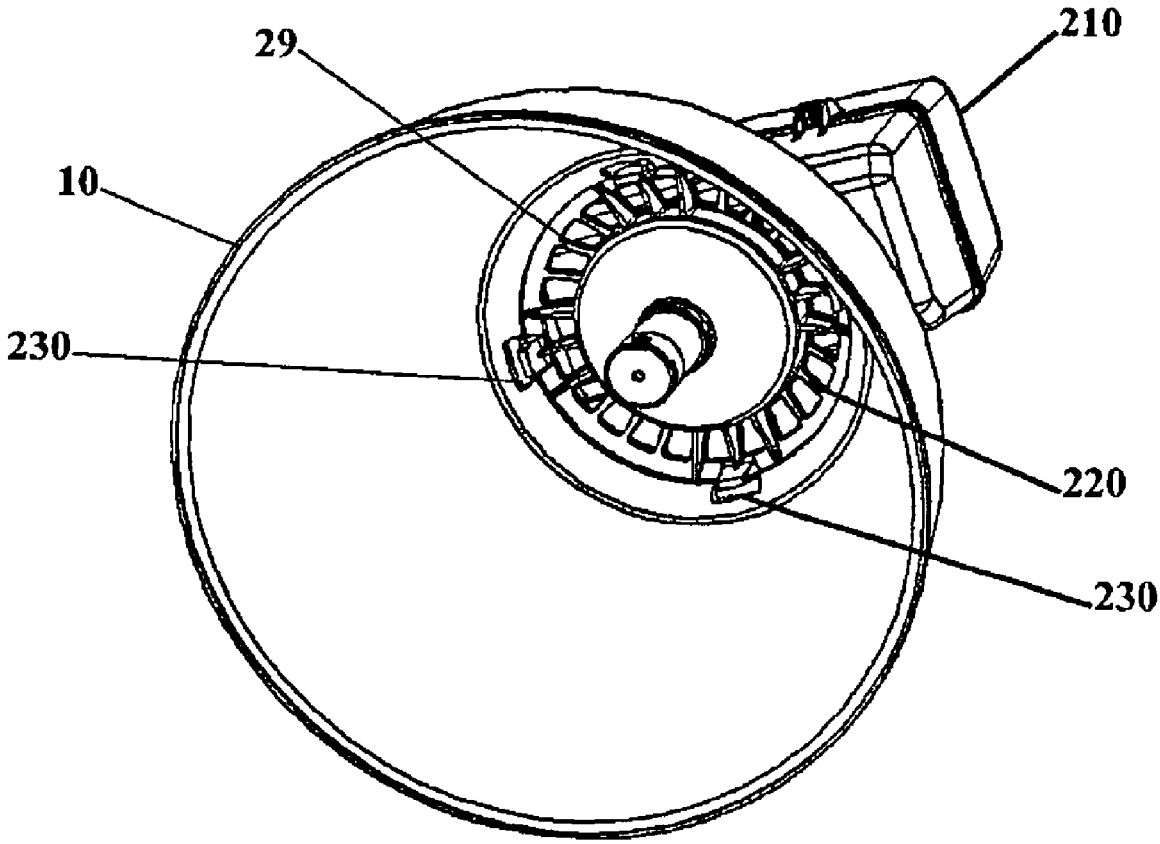
FIG. 10 is a perspective view of the lighting fixture showing a view from inside the reflective dome.

FIG. 10 is a perspective view of the lighting fixture showing a view from inside the reflective dome 10. This figure shows the reflective dome 10 attached to the dome retainer 220 with fastening tabs 230 holding the dome in position. Vents 29 are shown in this figure around the dome to allow heat to vent out the lighting fixture.

Figure 11:
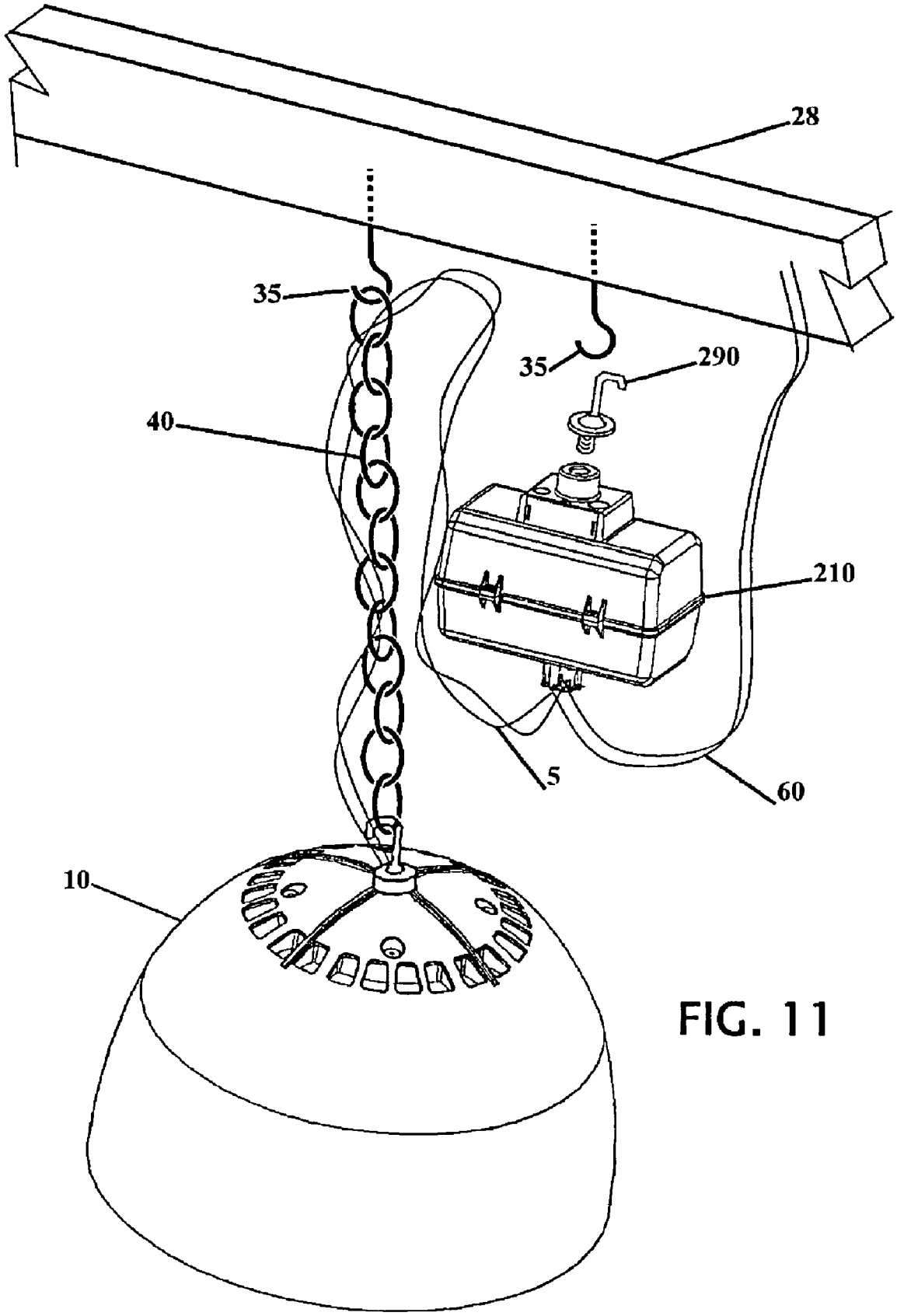
FIG. 11 is an isometric view of a one piece light dome with a separate ballast box.

FIG. 11 is an isometric view of a one piece light reflective dome 10 with a separate ballast box 210. In this embodiment the reflective dome 10 is cast from a clear, multi-colored, translucent, or opaque material and is then internally coated or painted with an aluminum or chrome to provide a reflective surface. The reflective dome 10 is made from a polycarbonate abs or other similar material as opposed to being cast or spun out of aluminum or other metal. The ballast box 210 is shown mounted separately from the lighting reflective dome 10, and prototypes have been made with a separation of 15 feet between the ballast and the lighting elements. The wiring 5 from the buildings electrical system 60 enters into the ballast box 210 and, after the voltage is converted, a separate set of wiring 5 connects to the lighting fixture reflective dome 10. This entire lighting system is attached to the ceiling or joist 28 of the building from hook 35, chain 40 and or hooks integrated into the lighting or ballast enclosure 290.

Figure 12:
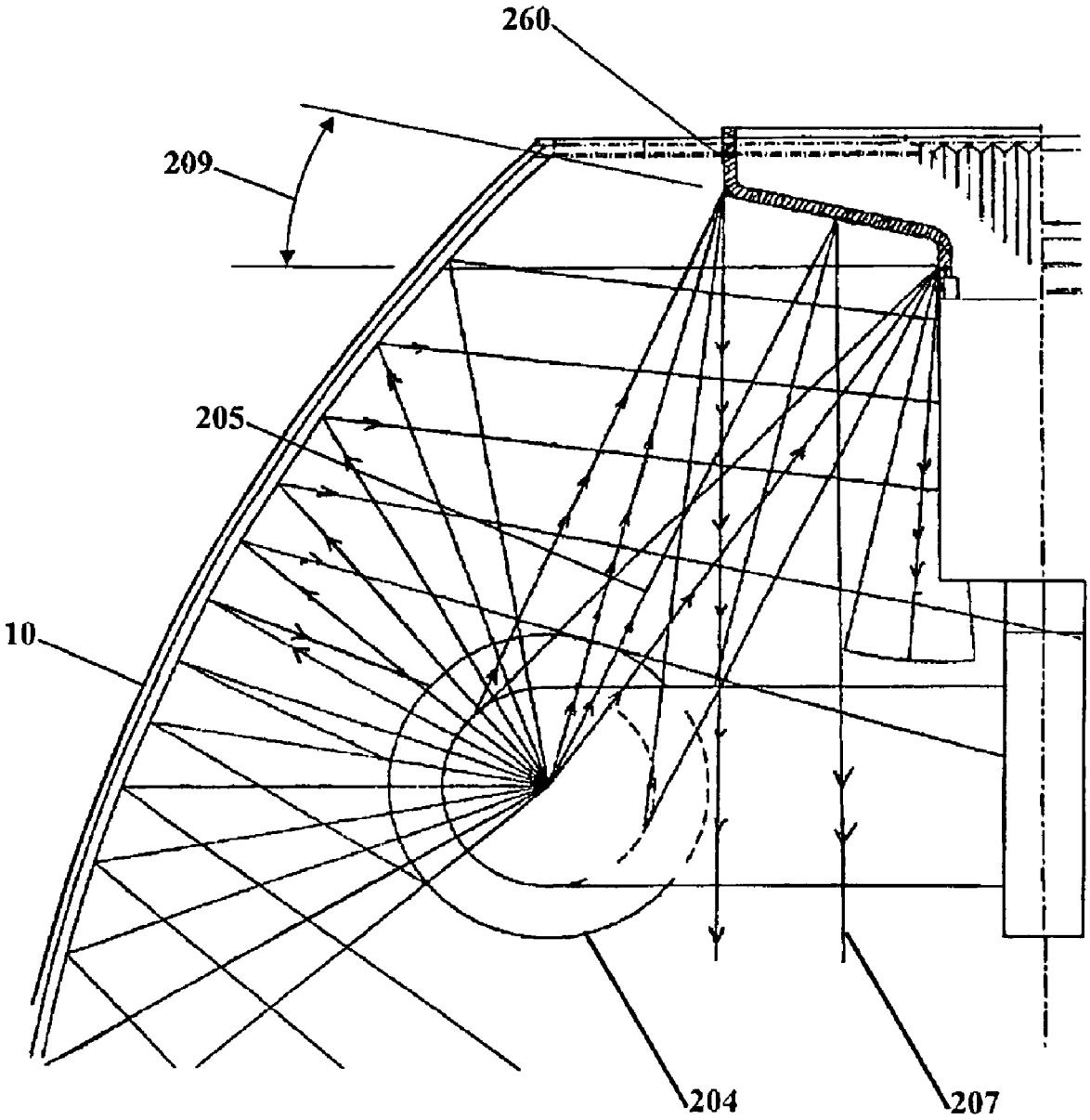
FIG. 12 is a view showing the light transmission and reflection rays of the dome and deflector.

FIG. 12 is a view showing the light transmission and reflection rays of the reflective dome 10 and the deflector 260. Placing a toroidal lighting element 204 within the reflective dome 10 can create a shadow that exists from the light of the lighting element blocking the light emitted from the back side of the lighting element. Different light diameters and different dimensions will yield varying reflective angles that will reflect the light from behind the lighting element to the front of the lighting fixture to eliminate the shadow that can be appear under the lighting reflective dome 10. In this figure, one of the light transmission lines 205 is shown emitting from the lighting element 204, reflecting off the deflector 260 and shinning down 207 to the ground. The geometry of the deflector dome 260 is designed to minimize or eliminate the shadow. Working prototypes have been made with reflective components angled 209 between 13 and 15 degrees but the ideal angle may be unique depending upon the size, shape and geometric location of the reflective dome 10, lighting element deflector and other components within the lighting fixture.

Thus, specific embodiments and applications of a lighting and replacement light fixture have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A high/low bay inductive light fixture comprising:

a ballast box for housing at least one ballast for an inductive lighting element, the ballast is configured for at least one inductive lighting element, a first electrical connection from the ballast to a power source, and a second electrical connection from the ballast to the at least one inductive lighting element, at least one inductive lighting element wherein when sufficient power is applied to the first electrical connection the ballast supplies power to the inductive lighting source that will provide illumination, a housing with at least one clip that flexes inward allowing a dome to pass the clip and then the clip springs back into position to position and removably retain the dome, and at least one locking bar that extend horizontal across and around opposing ends of the at least one inductive lighting element to hold each at least one inductive lighting elements in at least two places.

2. The high/low bay inductive light fixture from claim 1 wherein the at least one ballast box is fabricated from a molded or cast material.

3. The high/low bay inductive light fixture from claim 1 further having at least two lighting elements where each separate lighting element exists concentrically within the fixture and are connected to the said ballast.

4. The high/low bay inductive light fixture from claim 1 wherein the intensity of the illumination is adjustable from a variable power source to the ballast.

5. The high/low bay inductive light fixture from claim 1 that further includes at least one socket for connecting the at least one inductive lighting element.

6. The high/low bay inductive light fixture from claim 1 that further includes at least one retaining cable that extends through said single housing, said vented reflective dome and said lighting element.

7. A high/low bay lighting ballast box with integrated dome retainer comprising:

a single housing incorporating a ballast box, above a lighting fixture where the single housing includes a vented reflective dome and a lighting element;

said vents are configured with at least two wings that extend from the ballast box to the reflective dome wherein the wings include open areas that are located through the top of the vented reflective dome to provide for natural convection cooling of said lighting element, and wherein said vented reflective dome is attached to the single housing with an attachment mechanism consists of clips that flexes inward allowing said vented reflective dome to pass said clip and then said clip springs back into position to position and removably retain said vented reflective dome.

8. The high/low bay lighting ballast box with integrated dome retainer from claim 7 wherein the ballast box further includes a vented circular disk that is formed from two separate pieces that are securely connected.

9. The high/low bay lighting ballast box with integrated dome retainer from claim 7 wherein the venting on the vented reflective dome consists of a plurality of rectangular, circular, elliptical vents or combination thereof.

10. The high/low bay lighting ballast box with integrated dome retainer from claim 7 wherein the vented reflective dome is circular, rectangular, triangular, or a multi sided pyramid shape.

11. The high/low bay lighting ballast box with integrated dome retainer from claim 7 that further includes an electrical connection for making an electrical connection to provide external power to the ballast.

12. The high high/low bay lighting ballast box with integrated dome retainer from claim 7 that further includes at least one retaining cable that extends through said single housing, said vented reflective dome and said lighting element.

13. The high/low bay inductive light fixture from claim 7 wherein said intensity of the illumination is adjustable from a variable power source to said ballast.

14. The high/low bay inductive light fixture from claim 7 that further includes at least one locking bar that extend horizontal across and around opposing ends of said at least one inductive lighting element to hold each at least one inductive lighting elements in at least two places.

15. A high/low bay lighting ballast box with integrated dome retainer comprising:

a single housing incorporating a ballast box, above a lighting fixture where the single housing includes a vented reflective dome and a lighting element;

said vents are configured with at least two wings that extend from the ballast box to the reflective dome wherein the wings include open areas that are located through the top of the vented reflective dome to provide for natural convection cooling of said lighting element, and wherein the ballast box further includes a vented circular disk that is formed from two separate pieces that are securely connected.

16. The high/low bay lighting ballast box with integrated dome retainer from claim 15 wherein the ballast box further includes a vented circular disk that is formed from two separate pieces that are securely connected.

17. The high/low bay lighting ballast box with integrated dome retainer from claim 15 wherein the venting on the vented reflective dome consists of a plurality of rectangular, circular, elliptical vents or combination thereof.

18. The high/low bay lighting ballast box with integrated dome retainer from claim 15 wherein the vented reflective dome is circular, rectangular, triangular, or a multi sided pyramid shape.

19. The high/low bay lighting ballast box with integrated dome retainer from claim 15 that further includes an electrical connection for making an electrical connection to provide external power to the ballast.

20. The high/low bay lighting ballast box with integrated dome retainer from claim 15 wherein said vented reflective dome is attached to the single housing with an attachment mechanism consists of clips that flexes inward allowing said vented reflective dome to pass said clip and then said clip springs back into position to position and removably retain said vented reflective dome.

* * * * *